United States Patent [19]

Shen

[11] Patent Number: 4,744,232

[45] Date of Patent: May 17, 1988

[54] LATCHBOLT SLIDE EXTENSION

[76] Inventor: Richard Shen, P.O. Box 180, Tainan, R.O.C., Taiwan

[21] Appl. No.: 802,185

[22] Filed: Nov. 25, 1985

[51] Int. Cl.[4] ..... E05B 63/06

[52] U.S. Cl. ..... 70/380; 70/461; 292/1; 292/337

[58] Field of Search ..... 292/1, 337, 169; 70/380, 461

[56] References Cited

U.S. PATENT DOCUMENTS

| | | | |
|---|---|---|---|
| 2,250,036 | 7/1941 | Schlage | 292/337 |
| 2,297,077 | 9/1942 | Schlage | 292/337 |
| 2,299,181 | 10/1942 | Schlage | 292/1 |
| 2,765,187 | 10/1956 | Crandell | 292/1 |
| 2,775,475 | 12/1956 | Miller | 292/1 |
| 2,776,155 | 1/1957 | Gerlach | 292/1 |
| 3,046,042 | 7/1962 | Kane | 292/1 |
| 3,300,240 | 1/1967 | Tornoe et al. | 292/337 |
| 4,496,178 | 1/1985 | Best et al. | 292/337 |
| 4,623,174 | 11/1986 | Trull et al. | 292/1 |

*Primary Examiner*—Gary L. Smith
*Assistant Examiner*—Suzanne L. Dino
*Attorney, Agent, or Firm*—Sherman and Shalloway

[57] ABSTRACT

A latchbolt slide extension for a cylindrical lockset which comprises a spring-loaded latch and a cylindrical body. The slide extension is connected to the spring-loaded latch and the cylindrical body so as to make such cylindrical lockset with a shorter backset latch to be installed to a door with a larger backset.

1 Claim, 4 Drawing Sheets

LATCHBOLT SLIDE EXTENSION

BACKGROUND OF THE INVENTION

This invention relates to a slide extension for a cylindrical lockset and particularly to a cylindrical lockset for a door.

At present, referring to FIG. 4, two types of backsets (i.e. the distance (d) between the center of the bored hole and the door edge) are widely used; they are 2⅜" (60 mm) and 2¾" (70 mm).

The conventional cylindrical lockset for a door is a single-purpose product. This means that if a cylindrical lockset is suitable for the backset of 2⅜" (60 mm), then it can not be installed to a door of which the backset is 2¾" (70 mm). For this reason, the manufacturer has to make two different lengths of latch to meet individual requirements thereby increasing the cost.

Meanwhile, such a limitation causes confusion or inconvenience to the users for new installation or replacement.

It is, therefore, an object of the present invention to obviate and mitigate the above-noted drawbacks.

SUMMARY OF THE INVENTION

It is the primary object of the present invention to provide a slide extension which engages with a latch of with a shorter backset so as to enlarge the backset thereof.

It is another object of the present invention to provide a slide extension of a cylindricai lockset which can significantly reduce the production cost.

It is still another object of the present invention to provide a slide extension of a cylindrical lockset which is easy to fabricate.

It is a further object of the present invention to provide a slide extension for a cylindrical lockset which is practical for use.

DETAILED DESCRIPTION OF THE PREFERRED EMBODIMENT

Figure 1:
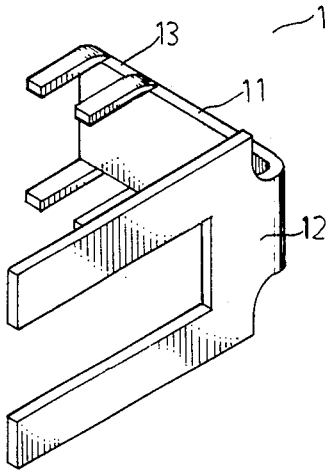
FIG. 1 is a perspective view of a preferred embodiment of the present invention.
Figure 2:
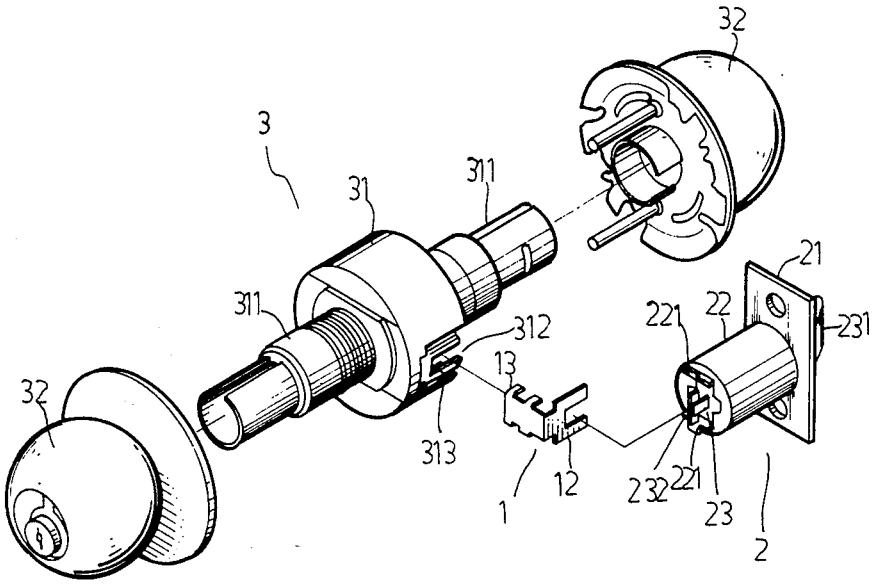
FIG. 2 is a fragmental view thereof illustrating the mechanism of the cylindrical lockset and the slide extension.

Referring to the drawings and particularly to FIGS. 1 and 2, a slide extension of 2⅜" (60 mm) backset latch for a cylindrical lockset mainly comprises a slide extension (1), a spring-loaded latch (2) and a cylindrical body (3).

Referring to FIG. 1, the slide extension (1) comprises a rectangular plate (11) which is provided at one end with a U-shaped member (12) perpendicular thereto and at the other end with a pair of parallel U-shaped members (13) which extend along the same direction as the U-shaped member (12).

Figure 3:
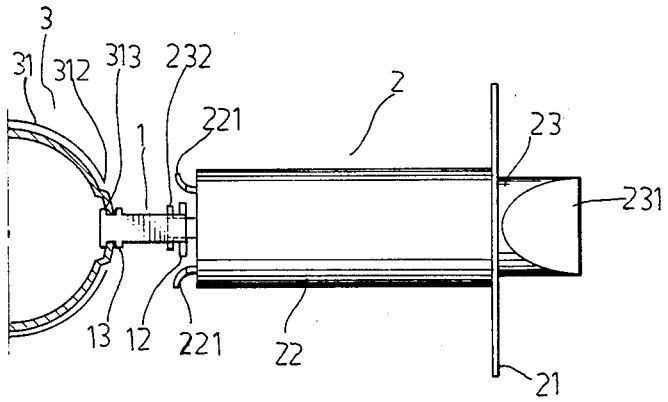
FIG. 3 is a cross-sectional view showing the slide extension being connected between the cylindrical body and the latch of a preferred embodiment of the present invention.

Referring to FIGS. 2 and 3, the spring-loaded latch (2) comprises a latch front (21). A latch case (22) passes through the latch front (12) and is secured thereto. One end of the latch case (22) is formed with a pair of hook plates (221) by which the latch (2) can be engaged with the cylindrical body (3). A sliding member (23) is furnished at one end with a latch bolt (231) and at the other end with a latch bar (232). The sliding member (23) is slidably disposed in the latch case (22) such that as the latch bolt (231) of the sliding member (23) is pressed into the latch case (22), the latch bar (232) thereof will be pushed out of the latch case (22).

Referring to FIG. 2, the lock body (3) mainly comprises a cylindrical housing (31) which is provided at both sides with outside and inside spindles (311). The cylindrical housing (31) is formed at the periphery with a U-shaped retractor (312). A pivotal shaft (not shown) provided with a retractor (313) is disposed in the interior of the cylindrical housing (31) to the latch bolt (231) by rotating the outside or inside knob (32).

Figure 4:
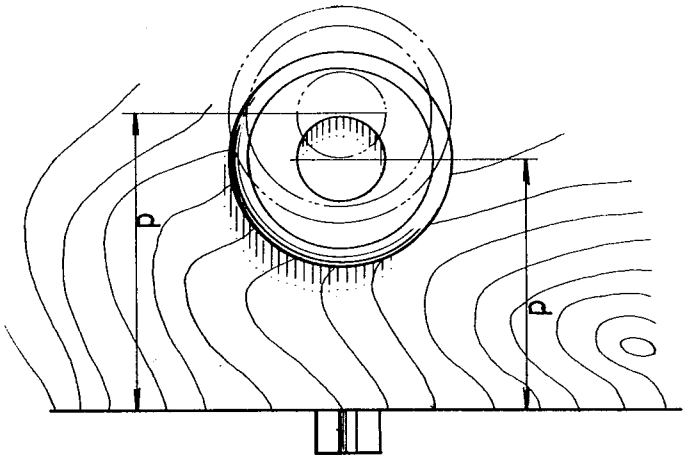
FIG. 4 is a simplified diagram illustrating two different backsets of the cylindrical lockset for a door.

Referring to FIG. 4, the backset is defined as the distance (d) between the center of the bored hole and the door edge. As described hereinbefore, presently there are two types of common backsets, i.e. 2⅜" (60 mm) and 2¾" (70 mm), being widely used. This present application is characterized in that the sliding extension (1) can be cooperated with the latch bar (232) of 2⅜" (60 mm) backset latch and the retractor (313) so as to extend the backset to 2¾" (70 mm).

In use, if the present case is intended to be installed in a door with the backset of 2⅜" (60 mm), the hook plate (221) of the latch (2) is directly engaged with the U-shaped retractor (312) of the cylindrical body (3) without using the sliding extension (1). Meanwhile, the latch bar (232) of the sliding member (23) of the latch (2) is engaged with the retractor (313) of the pivotal shaft of the cylindrical housing (31). Therefore, the latch bolt (231) of the sliding member (23) can be driven to move in a predetermined manner by means of rotating the knob (32).

On the other hand, if the present case is intended to be installed in a door with the backset of 2¾" (70 mm), the slide extension (1) is connected between the latch bar (232) and the retractor (313) in such a manner that the U-shaped member (12) of the slide extension (1) is engaged with the latch bar (232) of the sliding member (23) and said two parallel U-shaped members (13) thereof are engaged with the retractor (313) of the pivotal shaft.

Accordingly, the present invention has the following advantages:

1. This invention can fit a larger backset installation from a smaller backset latch.

2. The slide extension (1) is a simple-structure and low-cost product which is flexible in use.

3. The slide extension (1) is an easily detachable product which is easy to fabricate.

I claim:

1. In a slide extension for a cylindrical lockset having:

a spring-loaded latch comprising a latch front, a latch case passing through the latch front and being secured thereto, one end of the latch case being formed with hook plates, a sliding member being furnished at one end with a latch bolt and at the other end with a latch bar, the sliding member being slidably disposed in the latch case;

a cylindrical body comprising a cylindrical housing which is provided at both sides with a pair of rotatable spindles, the cylindrical housing being formed at the periphery with a U-shaped retractor, a pair of knobs being respectively secured to the spindles, a pivotal shaft provided with a retractor being disposed in the interior of the cylindrical housing such that the pivotal shaft can be driven to move the sliding member of the spring-loaded latch in a predetermined manner by means of rotating the knobs thereof; the improvement comprising a slide extension comprising a latch front which is formed at one end with a U-shaped member perpendicular thereto and at the other end with a pair of parallel U-shaped members which extend along the same direction as the U-shaped member whereby the U-shaped member thereof is engaged with the latch bar of the sliding member of the spring-loaded latch and said two parallel U-shaped members thereof are engaged with the retractor of the pivotal shaft of the lock body.

* * * * *